United States Patent [19]

Bishop et al.

[11] Patent Number: 4,501,180

[45] Date of Patent: Feb. 26, 1985

[54] ROTARY DIE-CUTTING

[75] Inventors: Thomas D. Bishop, Knowle; David John G. Bishop, Balsall Common, both of England

[73] Assignee: The Deritend Engineering Company Ltd., West Midlands, England

[21] Appl. No.: 460,531

[22] Filed: Jan. 24, 1983

[51] Int. Cl.[3] ..... B26D 7/18
[52] U.S. Cl. ..... 83/154
[58] Field of Search ..... 83/154

[56] References Cited

U.S. PATENT DOCUMENTS

| | | | |
|---|---|---|---|
| 3,242,781 | 3/1966 | Risica | 83/154 X |
| 3,270,602 | 9/1966 | Kirby et al. | 83/154 X |
| 3,999,454 | 12/1976 | Tiso et al. | 83/154 X |

*Primary Examiner*—Donald R. Schran
*Attorney, Agent, or Firm*—C. O. Marshall, Jr.

[57] ABSTRACT

A rotary die-cutter is arranged for front or rear edge stripping by providing spring fingers which are moved rearwardly, relative to the rotation of the impression cylinder, to engage the front edge scrap and clamp it on the roll, for movement with the roll out of the plane of feed of the web while the remainder of the blank is fed onwardly into said plane.

3 Claims, 9 Drawing Figures

ROTARY DIE-CUTTING

DESCRIPTION

This invention relates to rotary die-cutting of card and like material from blanks or web. This die-cutting is used for example to produce blanks of complex shape which can be erected into cartons or boxes. A carton may have a base, sides and a lid, with flaps to interconnect the parts, and all the rest of the blank (or web portion) is scrap.

There is an inherent difficulty in dealing with the scrap. If the cut between the required material and the scrap material is continuous and complete, the scrap may almost immediately separate from the required blank and it may get into an undesired position. If the blank is to be printed subsequently, it may prevent the ink reaching the blank. If the blanks are stacked and some kind of feed mechanism moves the blanks one by one from the stack, it may be a piece of scrap which is fed instead of a blank. And so on.

On the other hand, if the cut is discontinuous so that the scrap is still connected to the blank at a number of points after the die-cutting, to keep the two parts together until a deliberate stripping operation is carried out to perform the separation, the act of separation becomes that more difficult. The more positive the connection between the parts so as to reduce the chance of premature separation, the more difficulty there is in the separating step. The problem is worst (for various reasons which will be understood by those skilled in the art) with front edge scrap: that is to say with the leading part in the feed direction.

The object of the invention is to provide means for dealing with edge scrap.

According to the invention a rotary die-cutter comprises a roll pair having cutting tools for effecting complete separation of edge scrap from each blank or web portion, and has means for clamping said scrap to one roll and taking the same arcuately about that one roll of the pair.

The invention solves the problem of front-edge scrap, but is useful for rear-edge scrap also.

Preferably said means are provided on the impression roll, rather than on the roll which carries the cutting rule or the like.

Conveniently said means comprise a spacer plate extending over the full width of the impression roll and having a thickness measured radially of the same which exceeds the thickness of the blank or web, and a second plate carrying a plurality of spring fingers which are angularly movable with the second plate relative to the first plate so as to be extended rearwardly of the first plate and trap at least a margin of said front edge scrap (or forwardly of said plate to trap the rear-edge scrap).

The said second and movable plate may be urged in one direction angularly of the roll by spring means and be cam displayed in the opposite direction and if so it is preferred to have spring drive in the direction which takes the fingers over the blank and cam displacement in the opposite direction. Alternatively there may be cam-drive in both directions. The cam may be mounted on the roll axis or parallel thereto and driven at the same rotational speed and hence in timed synchronous relation to the roll, and a cam follower for example in the form of a bell crank can be pivoted to the roll for plate movement. If both front and rear edge scrap are to be treaded, two separated cams may be used.

In operation (in the front edge case) the spring fingers are in the scrap-trapping position at least from a position near the nip of the roll, so that as the leading edge of the blank or web enters the nip it is trapped and held to the surface of the roll by the spring clips. Shortly after the plate has passed through the nip, the cutting tool which forms the front edge of the blank passes through the nip and severs the scrap from the blank. During the next portion of the rotation of the roll the required part of the blank or web continues to feed on in substantially the same plane until it is picked up by feed rolls or the like leading to the next treatment stage of the apparatus. The severed portion of the blank, i.e. the scrap portion moves out of that plane because it is captive to the roll surface. At a position well spaced from the nip, for example by 90° interval, the movable plate is cam displaced so that the spring fingers are moved clear of the scrap piece. The scrap piece is then free to fall or be drawn from the roll for example by a suction device. At convenient point near the nip, the fingers are returned for the next cycle.

It will be appreciated that the front edge scrap portion can be integral with the side edge scrap portion which can be withdrawn from the plane of feed of the blank at the same time and in the same way, providing that the total length of such side edge scrap portion is less than the distance betwen the nip and the position at which the movable plate is retracted.

In some circumstances, and by using mechanism for feeding the web forwardly and then reversing it before a subsequent operation, it is possible that all of the stripping of scrap from the web can be accomplished with a single set of the apparatus of the present invention. In other cases, a separate stripping mechanism will be used for other than front edge portions.

It will also be appreciated by those skilled in the art that the front or rear edge is rarely if ever a single straight line. According to a feature of the invention, the spring fingers are adjustable on the said second plate so as to project for different distances from the same, and preferably also said second plate is provided with a plurality of attachment points so that the spring fingers can be located in a selection of possible locations along the length of said plate.

The invention is more particularly described with reference to the accompanying drawings wherein.

Figure 1:
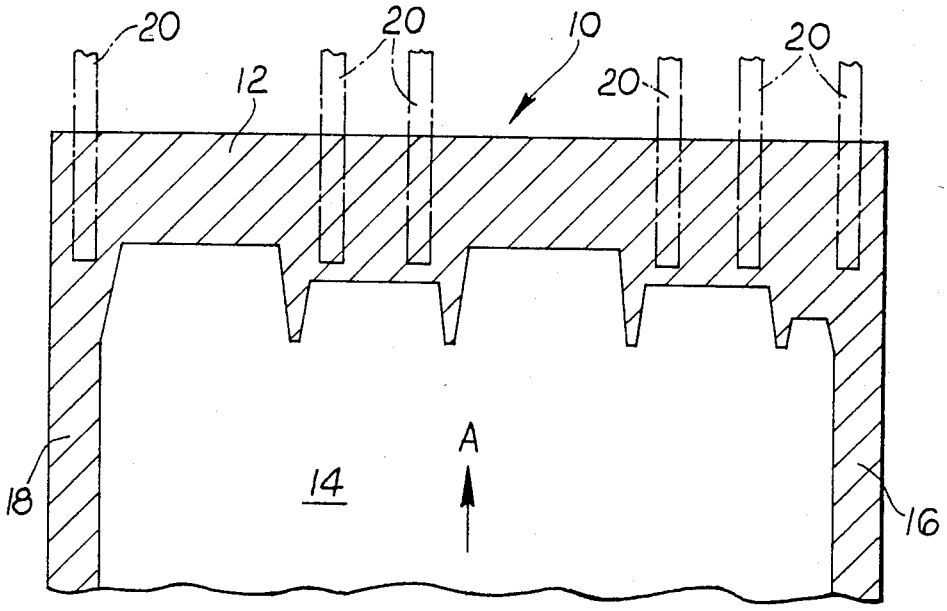
FIG. 1 is a diagrammatic fragmentary plan view showing a portion of a blank.

Referring now to the drawings, the blank or portion of web shown in FIG. 1 has a leading end 10 and the shaded portion 12 is the front edge scrap which is to be moved leaving the finished blank proper 14. In this illustrative example, the front edge scrap is unitary with side edge scrap 16 18. The possible positions of six separate spring fingers for engagement with that front edge scrap are shown by the chain dot lines 20.

Figure 2:
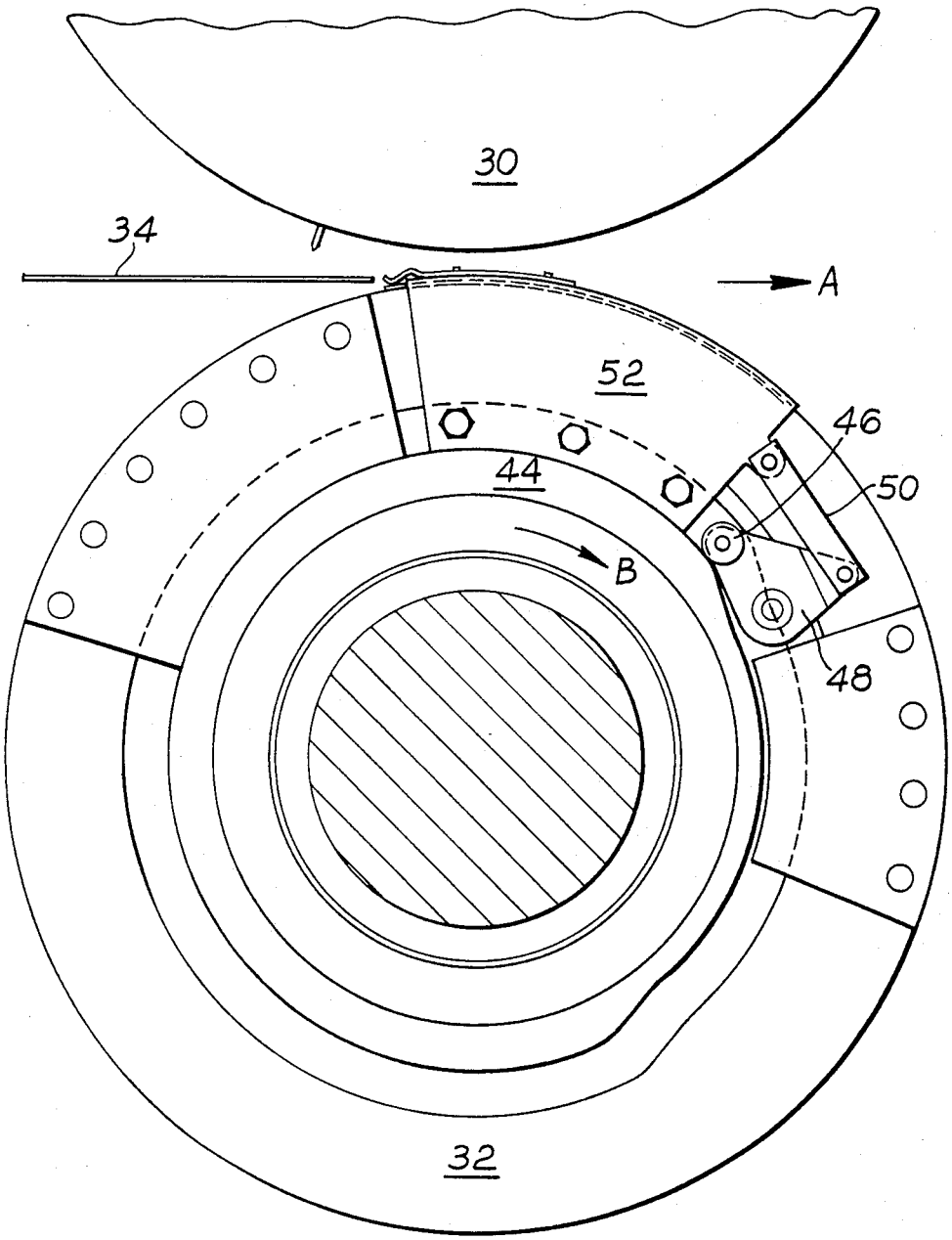
FIG. 2 is a somewhat diagrammatic elevation of a stripping apparatus.

The apparatus shown in FIG. 2 comprises a cutting cylinder 30 and an impression cylinder 32 and the blank or web 34 is fed through the nip therebetween generally in the direction of the arrow A in the figures.

Figure 3:
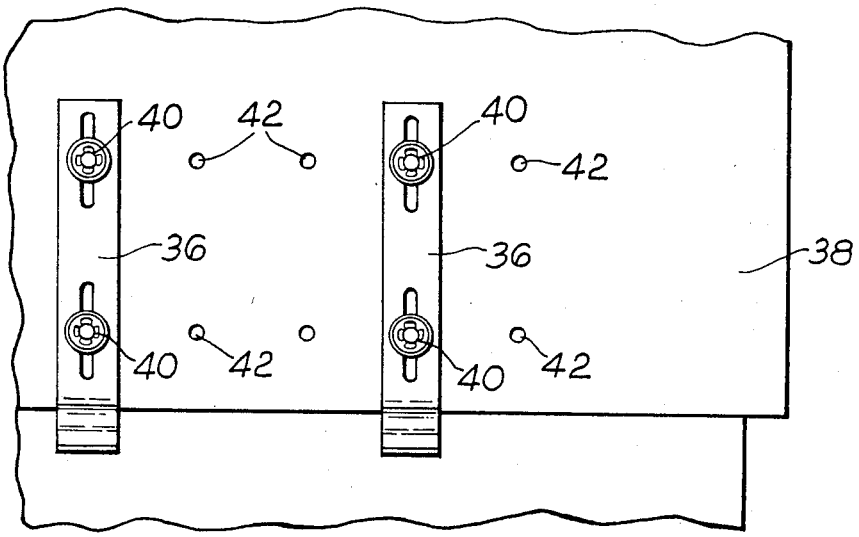
FIG. 3 is a fragmentary plan view of the apparatus.

The means for trapping the front edge scrap is more particularly described with reference to FIGS. 4 to 9, but in general it comprises a series of spring fingers 36 as in FIG. 3 attached to a plate 38 in any of a plurality of positions across the plate and also in selected positions of adjustement by means of slots in the fingers through which anchor pins project. Spring clips 40 fix the fingers to the pins. Attachment holes 42 are provided in a regular series along the length of said plates. The plate 38 is arranged to be moved generally in the direction of the arrow B in FIG. 2, and in the reverse direction, by a cam 44 provided on the impression cylinder with a cam follower 46 driving a bell crank 48 connected by a link 50 to displace the flank plate 52 carrying said plate 38.

As best seen in FIGS. 4 to 9, the impression cylinder 32 is provided with a first plate 54 of which the trailing edge (in the direction of movement of the impression cylinder B) forms an abutment for the most advanced part of the leading edge of the blank. It will be appreciated that the impression cylinder is in timed relation to the cutting cylinder.

Figure 4:
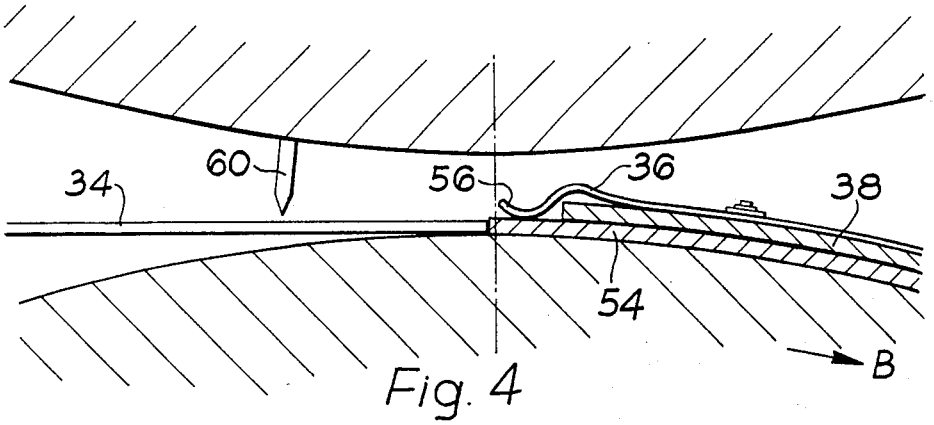
FIGS. 4 to 9 are diagrammatic views showing the stripping apparatus (on an enlarged scale) in a series of successive positions.

As the cylinders turn, the blank advances against the abutment formed by said edge, at a time when the second plate 38 is in its most forward position, as shown in FIG. 4. The trailing ends 56 of the spring fingers 36 at this time rest on the first plate 54 adjacent said trailing edge.

Figure 5:
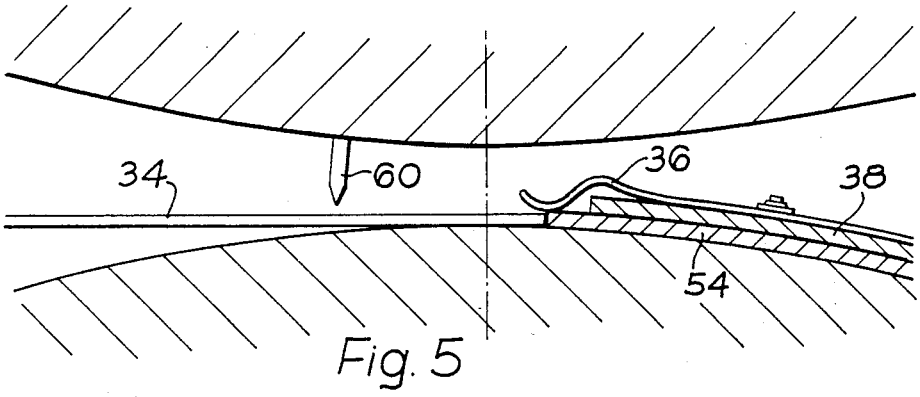
Figure 6:
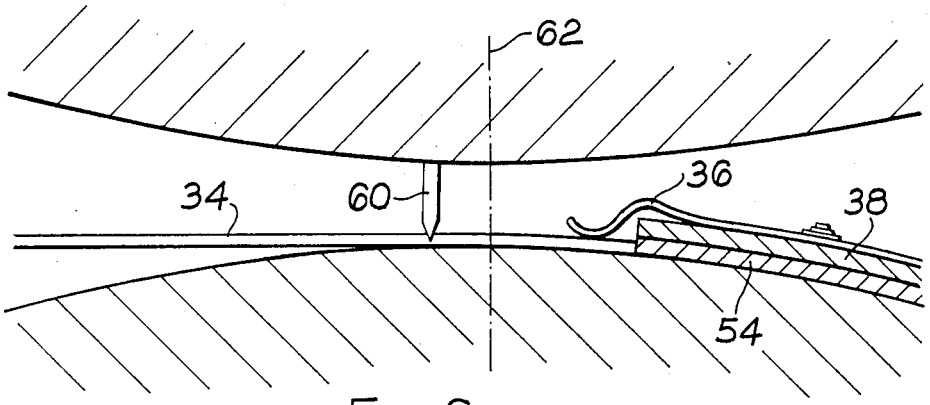

As the apparatus advances to the FIG. 5 position, the cam commences displacement of the plate 38 and this continues in the FIG. 6 position so that the spring fingers engage on the front edge scrap. At this point, or about this point, the cutting rule 60 which is to sever the front edge scrap from the blank, engages the blank, the cut actually being completed when the cutting rule passes through the vertical plane represented by the chain dot line 62.

Figure 7:
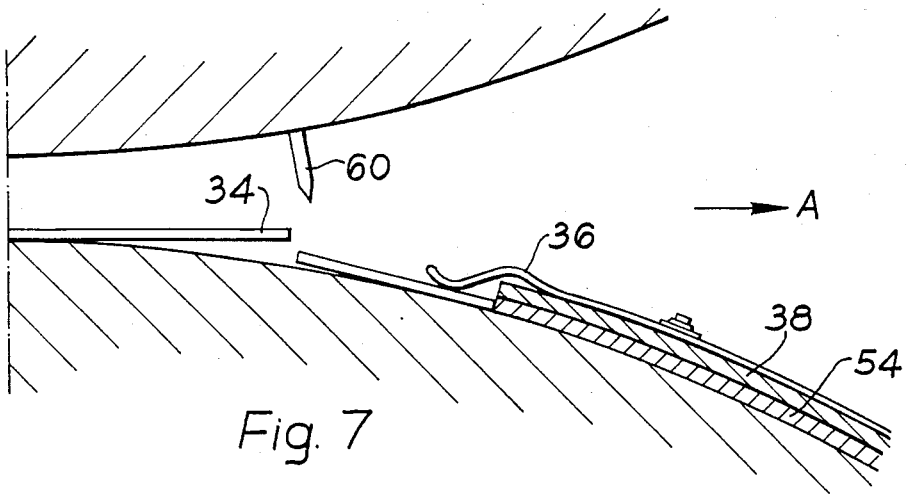

FIG. 7 shows the position when the cutting rule has passed through that vertical plane and the front edge scrap separated from the blank, so that the blank continues being fed onwardly in the arrow A direction whilst the scrap is trapped between the spring fingers and the treatment roll and continues being angularly displaced about the rotational axis of the treatment roll, and hence begins to be displaced out of the plane of feed of the blank or web.

Figure 8:
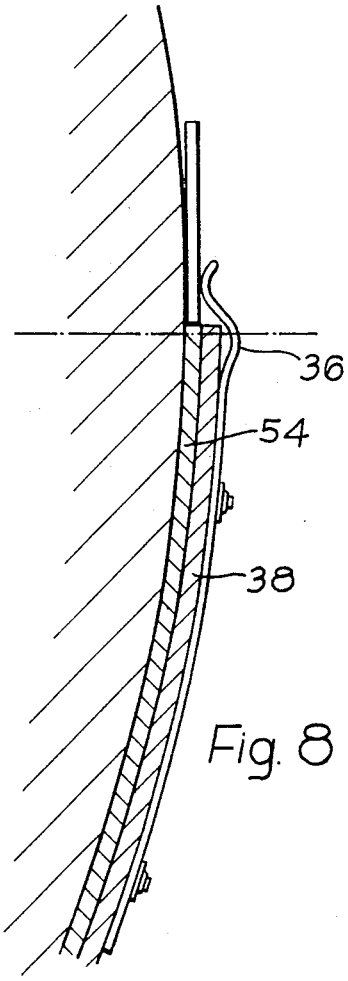
Figure 9:
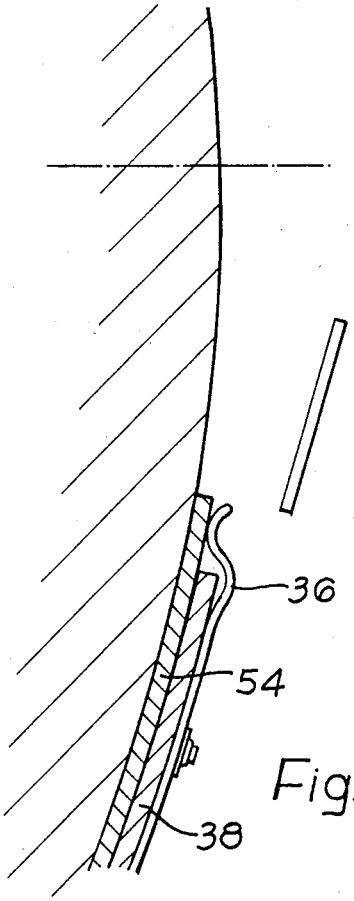

FIGS. 8 and 9 show positions about 90° removed from FIG. 7, when the front edge scrap is now in a plane generally at right angles to that of feed of the web or blank, this position being dictated by the configuration of the cam track. As the cam follower passes from the one portion of the cam to the other, the spring fingers are forwardly displaced from the FIG. 8 position to the FIG. 9 position, thus being disengaged from the scrap piece as they pass from the scrap piece to the first plate 54, thus releasing the scrap piece so that it can fall or be drawn for example by a current of air, to a scrap conveyor for removal.

We claim:

1. A rotary die-cutter comprising a cutting roll having cutting tools projecting from the surfaces of the roll for effecting complete separation of edge scrap from each of a succession of blanks, and a substantially cylindrical impression roll provided with means for clamping said scrap thereto and for taking the scrap arcuately about that roll, said means comprising a spacer plate secured to the surface of the impression roll with a thickness exceeding that of a blank, and a second plate mounted on the spacer plate and circumferentially movable thereon whilst carrying a plurality of spring fingers which can be extended beyond the edge of the first plate to trap said scrap.

2. A rotary die-cutter as claimed in claim 1 wherein the second plate has a plurality of positions for selective location of spring fingers.

3. A rotary die-cutter as claimed in claim 1 wherein the spring fingers are mounted on said second plate for adjustment in a circumferential direction.

* * * * *